United States Patent [19]

Grzeskowiak et al.

[11] Patent Number: 4,711,838

[45] Date of Patent: Dec. 8, 1987

[54] PHOTOGRAPHIC ELEMENTS SENSITIVE TO NEAR INFRARED

[75] Inventors: Nicholas E. Grzeskowiak, Harlow, Great Britain; James B. Philip, Jr., St. Paul, Minn.

[73] Assignee: Minnesota Mining and Manufacturing Company, St. Paul, Minn.

[21] Appl. No.: 769,596

[22] Filed: Aug. 26, 1985

[51] Int. Cl.[4] ..... G03C 1/02; G03C 1/76; G03C 1/84; G03C 1/06

[52] U.S. Cl. ..... 430/568; 430/510; 430/517; 430/523; 430/564; 430/578; 430/944; 430/945; 430/950

[58] Field of Search ..... 430/510, 523, 950, 517, 430/944, 945, 568, 495, 564, 578

[56] References Cited

U.S. PATENT DOCUMENTS

| | | | |
|---|---|---|---|
| 2,992,107 | 7/1961 | Kaplan et al. | 96/35 |
| 3,322,037 | 5/1967 | Cavagnero | 90/11 |
| 3,507,678 | 4/1970 | Shimizu et al. | 117/34 |
| 3,565,630 | 2/1971 | Millikan et al. | 430/568 |
| 3,600,183 | 8/1971 | Philippaerts et al. | 430/578 |
| 3,623,881 | 11/1971 | Fumia et al. | 430/578 |
| 3,695,888 | 10/1972 | Hiller et al. | 96/123 |
| 3,754,924 | 8/1973 | De Geest et al. | 96/114.2 |
| 3,765,901 | 10/1973 | Schellekens et al. | 430/568 |
| 4,022,622 | 5/1977 | Timmerman et al. | 96/67 |
| 4,144,064 | 3/1979 | Vermeulen et al. | 430/510 X |
| 4,235,959 | 11/1980 | Thijs et al. | 430/531 |
| 4,266,010 | 5/1981 | Nagatomo et al. | 430/355 |
| 4,343,873 | 8/1982 | Sasaoka | 430/1 |
| 4,376,817 | 3/1983 | Steiger et al. | 430/578 |
| 4,515,888 | 5/1985 | Beretta et al. | 430/584 |
| 4,551,424 | 11/1985 | Ikeda et al. | 430/523 X |

FOREIGN PATENT DOCUMENTS

| | | |
|---|---|---|
| 0101646 | 2/1984 | European Pat. Off. . |
| 2033569 | 5/1980 | United Kingdom . |
| 2077935 | 12/1981 | United Kingdom . |

*Primary Examiner*—John E. Kittle
*Assistant Examiner*—Mukund J. Shah
*Attorney, Agent, or Firm*—Donald M. Sell; James A. Smith; Mark A. Litman

[57] ABSTRACT

Photographic elements which may be imaged by laser scanners emitting in the near infrared without the formation of interference fringes comprising a support bearing one or more layers of a silver halide emulsion having grains of an average diameter of no more than 0.4 micron, the element including one or more of:

(i) a topcoat layer which is an outermost layer on the same side of the support as the photosensitive emulsion which topcoat layer is a diffuse transmitting layer with respect to near infrared radiation, (ii) a backing layer which is an outermost layer on the side of the support remote from the photosensitive emulsion which backing layer is a diffuse reflecting layer or absorbing layer with respect to near infrared radiation, (iii) a subbing layer which is positioned between the support and the photosensitive emulsion which subbing layer is a diffuse transmitting or absorbing layer with respect to near infrared radiation.

Whereby the element may be imaged by a laser scanning system emitting near infrared radiation substantially without formation of non-contact interference fringes.

27 Claims, No Drawings

PHOTOGRAPHIC ELEMENTS SENSITIVE TO NEAR INFRARED

FIELD OF THE INVENTION

This invention relates to photographic elements sensitive to light emitted in the near-infrared portion of the spectrum, from 750 nm and above, especially 750 to 1500 nm, and in particular to photographic elements adapted to provide a high quality recording medium for laser diode scanning systems.

BACKGROUND OF THE INVENTION

A widely used image processing technique is to convert a visible image into electronic data by encoding the brightness of adjacent small areas of the visible image. Such electronic encoding is advantageous for manipulation, transmission and storage of images. It is known to reconvert electronic data into visible images by means of a so-called "scanner system" whereby a finely focussed beam of light is rapidly scanned across a light sensitive medium in a succession of abutting raster lines, whilst modulating the intensity of light so as to reproduce the required image densities, based on the electronic signals.

Lasers, especially those using argon, krypton, helium-neon or helium-cadmium mixtures as the gas lasing media, have been used as sources of high intensity light for this imaging technique. However, the lasers all suffer the disadvantage of requiring an additional, complex device to modulate the intensity of light emitted, and to a greater or lesser extent, from large physical bulk, mechanical fragility and expense of manufacture.

Semiconductor laser diodes are potentially highly suitable as light sources for scanner systems in that their light output can be directly modulated by the electrical signal input, and that they are very compact and physically durable.

However, at present the only commercially available laser diode devices to have acceptably long operational life-times, and be capable of cheap manufacture, are those emitting light in the near-infrared (NIR) portion of the spectrum, from 750 to 1500 nm. Accordingly, in order to utilize laser diode scanner systems for imaging purposes it is necessary to provide a recording medium which is sensitive to light in the NIR range.

It is known to spectrally sensitise photographic silver halide emulsions to near-infrared light, using long chain cyanine dyes, see, for example, Mees and James, The Theory of the Photographic Process, 3rd Edition, MacMillan, 1966, pp. 198–201 and references cited therein.

It has been found that NIR sensitised photographic films, especially those having silver halide grains of mean diameter less than 0.4 micron, when supported by the edges in a glassless holder, to prevent contact with other surfaces, and given a uniform overall exposure from a laser diode scanner system emitting at 820 nm, produce images covered with broad swirling interference patterns, referred to hereinafter as "non-contact scanner fringes". These fringes are believed to arise as a result of the reflection of the exposing light from the two interfaces of the film element with surrounding air. The path difference between the rays reflected from the top surface of the film and the bottom surface is controlled by the thickness of the film at a given point, and the net phase difference causes either destructive or constructive interference, causing either diminished or increased exposure to be transmitted into the light sensitive emulsion layer at that given point. The fringes therefore follow contours of microscopic thickness variation in the film element itself, and cover the whole of the image area with broad lines usually about 1 mm apart and often several centimeters in length.

Non-contact interference fringes have not previously been reported in the literature in relation to silver halide emulsion materials. This phenomenon does not occur under the normal conditions of exposure with visible light because the turbidity of the photosensitive emulsion layer is sufficient to scatter the reflections from the back of the film element. However, because of its longer wavelength, infrared light is able to pass without serious scattering through small-grained photographic emulsions, and the coherence of the laser diode output enhances the tendency to form interference patterns. Thus, a photographic emulsion having silver halide grains of mean diameter 0.28 micron, with a coating weight of silver of 3 g/m$^2$, shows detectable fringes. Lowering the grain size to 0.23 micron or reducing the coating weight causes more noticeable patterns, whilst emulsions of mean grain diameter 0.20 micron or less exhibit severe fringes after non-contact laser diode scanning.

Non-contact scanner fringes seriously degrade the quality of scanner images, especially those having continuous tone gradation. They are not only aesthetically displeasing but they also obscure important information conveyed by small density differences in the image. It is desirable to be able to use photographic emulsions having grains of mean diameter less than 0.4 micron preferably less than 0.30 micron. Fine grain emulsions having a grain size of 0.4 micron or less are advantageous in permitting high spatial resolution, and in having high covering power, permitting a lower coating weight of silver to produce a given maximum optical density after development. Accordingly, photographic elements for use with laser diode scanning systems must be capable of suppressing non-contact interference fringes.

The phenomenon of interference fringes is not unknown in optical recording systems. When exposing shiny surfaced photographic films in contact with other shiny surfaces, e.g. glass supports, dot screens or contact printing negatives, a common problem is the occurrence in the developed image of closely spaced concentric fringe patterns, known as "Newton's rings", see, Encyclopedic Dictionary of Physics, J. Thewlis, Ed., Pergamon, London, 1961, p. 878. These fringes arise due to optical interference between reflections from the top surface of the film and the bottom surface of the contacting support; the size of the local air gap determines the path difference between these two sets of rays, and hence whether their phase difference gives rise to a light or dark fringe causing additional or diminished exposure to be transmitted into the emulsion layer. Newton's rings tend to form isolated areas of pattern, radiating concentrically from the points of contact during exposure, with a narrow fringe spacing which becomes progressively smaller towards the edge of each pattern. These are quite different in appearance to the broad swirling non-contact scanner fringes which cover the whole image area with broad lines usually about 1 mm apart and often several centimeters in length.

Methods are known in the art to prevent formation of Newton's rings. For example, it is known to incorporate matting particles in the outer surface of films. Examples of known matting particles include silica, poly-methyl methacrylate (PMMA), other polyvinyl compounds including copolymers, starch or inorganic salts. The density of matting coverage varies from a relatively small number (e.g. applied at less than 0.1 g/m$^2$) of fairly large particles usually 5 to 10 micron in diameter as disclosed in U.S. Pat. Nos. 4,235,959, 4,022,622, 3,754,924 and 2,322,037, to a particle weight of greater than up to 1 g/m$^2$ or 50% of the topcoat binders as disclosed in British Patent Specification Nos. 2 077 935 and 2 033 596 and U.S. Pat.

Nos. 3,507,678 and 2,992,101 utilizing smaller particle sizes.

Use of visible laser light as illumination for contact screen exposure of both emulsions produces particularly severe Newton's rings fringes. U.S. Pat. No. 4,343,873 discloses a photographic element designed to minimise such fringes which includes a light-scattering layer through which the light-sensitive layer is exposed to laser light. The light-scattering particles have a diameter of from 50 to 150% of the wavelength of the illuminating laser. The light scattering layer may be coated as an outer layer on the photographic element or beneath other layers.

It is also known to use matting agents in photographic elements for non-optical properties, such as resistance to adhesion, abrasion resistance, retouchability, good draw-down in vacuum frames, and reduced static effects. An example of the use of a matting agent is an infrared sensitive film is disclosed in U.S. Pat. No. 4,266,010 which describes an emulsion topcoat containing PMMA of size in the range 0.2 to 10 micron in an acid-processed gelatin binder, stating this to be suitable for all types of photographic materials including infrared films. A further example is disclosed in U.S. Pat. No. 3,695,888 which describes a photographic emulsion sensitised to infrared light by cyanine dyes with mesoalkylamino substituents and specific super-sensitisers, stating that such elements can contain matting agents such as starch, titanium dioxide, zinc oxide, silica, polymeric beads, including 1 to 4 micron beads of a methacrylic acid-methyl methacrylate copolymer disclosed in U.S. Pat. No. 2,992,101 and 1 to 20 micron polymethyl methacrylate beads formed by emulsion polymerisation as disclosed in U.S. Pat. No. 2,701,245.

It has been found that the known types of layers used on photographic elements for suppressing Newton's rings do not prevent the formation of non-contact interference fringes for photographic elements having a photographic emulsion of fine grain size sensitised to the near-infrared.

BRIEF DESCRIPTION OF THE INVENTION

According to the present invention there is provided a photographic element comprising a support transparent to near infrared radiation above 750 nm, generally in the range 750 to 1500 nm, one or more layers of a silver halide emulsion having grains of an average diameter of not more than 0.4 micron, sensitised to near infrared radiation, characterised in that the element comprises one or more of:

(i) a topcoat layer which is an outermost layer on the same side of the support as the photosensitive emulsion which topcoat layer is a diffuse transmitting layer with respect to near infrared radiation, (ii) a backing layer which is an outermost layer on the side of the support remote from the photosensitive emulsion which backing layer is a diffuse reflecting layer or absorbing layer with respect to new infrared radiation, (iii) a subbing layer which is positioned between the support and the photosensitive emulsion which subbing layer is a diffuse transmitting or absorbing layer with respect to near infrared radiation, whereby the element may be imaged by a laser scanning system emitting near infrared radiation substantially without formation of non-contact interference fringes.

A photographic element in accordance with the invention is resistant to the formation of internal optical interference patterns which cause unprotected fine grain near-infrared films to become covered in broad swirling fringes when processed after scanning with a laser diode NIR light source, despite non-contact of the film with other surfaces during exposure.

Three main techniques have been found for preventing formation of non-contact interference fringes, which techniques may be used alone or in combination.

It has been found that the microscopic surface roughness of the element can play an important part in inhibiting the formation of interference fringes. A microscopic surface roughness having 200,000 protrusions per square millimeter provides a marked reduction in the formation of interference fringes and a surface roughness on the backside of the film having 250,000 protrusions per square millimeter will substantially completely eliminate interference fringes, as will a surface roughness of more than 250,000, preferably, 450,000 protrusions per square millimeter on the top surface.

A second technique of inhibiting the formation of interference fringes is to provide a backing or subbing layer containing a dye absorbing light in the wavelength range of the exposing source. When such a layer is used alone as fringe suppression layers of the invention means the layer should have a peak transmission optical density of at least 0.75; when such a layer is used in combination with other fringe suppression means an optical density of at least 0.3 will make a significant contribution to the fringe reduction.

The third technique for reducing fringe formation employs a backing and/or topcoat layer comprising a binder containing particles having a high refractive index substantially preferably greater than 0.3 larger than that of the binder, e.g. desensitised silver halide particles in gelatin.

The use of silver halide particles is advantageous as the halide may be removed during the processing of the photographic element. The high refractive index layer may desirably be removed subsequent to exposure, such as by applying a solvent for the binder.

It has been found that there are several constructions of fine grain near-infrared sensitive photographic elements which will substantially completely suppress the formation of non-contact interference fringes. For example, non-contact interference fringes may be suppressed in such photographic elements incorporating one or more of the methods in the following constructions:

(1) A backing layer on the side of the film base remote from the photosensitive emulsion, comprising a binder containing a surface roughening agent having average particle size not more than 2 micron, generally in the range 0.1 to 2 micron and preferably 0.2 to 2 micron, this outer backing layer having a microscopic roughness of the outer surface, such that each square millimeter of that surface contains at least 250,000 particles which protrude above the average level of that surface by at least 30% of their individual diameters, or by 0.2 micron, whichever is less.

(2) A topcoat layer on the same side of the film base as the photosensitive emulsion, comprising a binder containing a surface roughening agent having average particle size not more than 1.5 micron, generally in the range 0.1 to 1.5 micron, and preferably 0.2 to 1.5 micron, this topcoat layer having a microscopic roughness of the outer surface, such that each square millimeter of that surface contains at least 250,000 preferably at least 450,000 particles which protrude above the average level of that surface by at least 30% of their individual diameters, or by 0.2 micron, whichever is less.

(3) A backing or subbing layer containing an antihalation dye absorbing light above 750 nm, preferably in the wavelength range 750 to 1500 nm and having a peak transmission optical density of at least 0.75, in that region.

(4) An outermost backing layer containing an antihalation dye giving a peak transmission optical density of at least 0.3 with respect to light above 750 nm, preferably in the wavelength range 750 to 1500 nm, and containing a surface roughening agent of average particle size not more than 2 micron, generally in the range 0.1 to 2 micron, and preferably 0.2 to 2 micron, this layer having a microscopic roughness of the outer surface such that each square millimeter of that surface contains at least 200,000 particles which protrude above the average level of that surface by at least 30% of their individual diameters, or by 0.2 micron, whichever is less, this layer optionally being divided into two separate layers, an outermost backing layer containing the surface roughening agent and the inner backing layer containing the antihalation dye.

(5) The combination of a backing layer having a peak transmission optical density of at least 0.3 with respect to light above 750 nm, preferably in the wavelength range 750 to 1500 nm, and an outermost topcoat layer containing a surface roughening agent having an average particle size not more than 2 micron, generally in the range 0.1 to 2 micron, and preferably 0.2 to 2 micron, this layer having a microscopic roughness of the outer surface such that each square millimeter of that surface contains at least 200,000 particles which protrude above the average level of that surface by at least 30% of their individual diameters, or by 0.2 micron, whichever is less.

(6) The combination of an antihalation layer having a peak transmission optical density of at least 0.3 with respect to light above 750 nm, preferably in the wavelength range 750 to 1500 nm, positioned between the photosensitive layer and the base, and an outermost backing layer or topcoat layer containing a surface roughening agent having an average particle size not more than 2 micron, generally in the range 0.1 to 2 micron, and preferably between 0.1 to 2 micron, this layer having a microscopic roughness of the outer surface such that each square millimeter of that surface contains at least 200,000 particles which protrude above the average level of that surface by at least 30% of their diameters, or by 0.2 micron, whichever is less.

(7) A topcoat layer containing a surface roughening agent having an average particle size not more than 2 micron generally in the range 0.1 to 2 micron add preferably between 0.2 to 2 micron, this layer having a microscopic roughness of the outer surface such that each square millimeter of that surface contains at least 200,000 particles which protrude above the average level of that surface by at least 30% of their individual diameters, or by 0.2 micron, whichever is less, in combination with an outermost backing layer containing a surface roughening agent having an average particle size not more than 2 micron generally in the range 0.1 to 2 micron and preferably between 0.2 to 2 micron, this layer having a microscopic roughness of the outer surface such that each square millimeter of that surface contains at least 200,000 particles which protrude above the average level of that surface by at least 30% of their individual diameters, or by 0.2 micron, whichever is less, and optionally a layer positioned between the backing layer and the support containing an antihalation dye providing a peak transmission optical density of at least 0.3 with respect to light above 750 nm, preferably in the wavelength range 750 to 1500 nm.

(8) A backing and/or topcoat layer comprising a binder containing particles having a refractive index substantially larger than that of the binder (e.g. non-sensitised silver halide particles) said particles having an average particle size below 5 micron and preferably 0.2 to 3 micron, the layer being removable during photographic processing.

It has been found that the microscopic roughness of the photographic element markedly affects the propensity of the element to form non-contact interference fringes when imaged with a scanning laser. In particular, it has been found that the provision of an outer backing layer providing a microscopic roughness having at least 250,000 protrusions per square millimeter above the average level of the surface will prevent fringe formation, assuming irradiation takes place from the other side of the element. Similarly, fringe formation can be prevented by provision of a topcoat layer the microscopic surface roughness providing at least 250,000 preferably 450,000 protrusions per square millimeter assuming the element is irradiated from the same side as this layer. This microscopic surface roughness is significantly different from that found in prior art photographic elements incorporating layers of matting agents; in general matting layers in the prior art tend to provide surfaces with less than half the number of protrusions than those required in the present invention and often contain less than one tenth of the number of protrusions than the surfaces used in the invention.

It is possible to substantially suppress fringe formation by employing a backing or subbing layer incorporating an antihalation dye to provide a peak transmission optical density of at least 0.75 in the range 750 to 1500 nm.

Combinations of surface roughening layers and antihalation layers may be employed as described above in which case the critical parameters of surface roughening and optical density for each individual layer may be reduced compared to that required when such layers are used as the only means for reducing fringe formation since the effect of the combination of layers is additive. It has been found that a suitable microscopic surface roughness for an outer layer to be used in combination with a further fringe suppressing layer is 200,000 protrusions per square millimeter. The optical density required by an antihalation layer to be used in combination with a surface roughening layer is at least 0.3.

Particle-containing surface layers described above are preferably used on the back surfaces of the elements, or on both outermost surfaces, rather than as topcoats on the photosensitive emulsion side only, since, surprisingly, the suppression of non-contact laser scanner fringes by surface roughened backings is superior to that by similar topcoats on the emulsion side assuming the exposure is from the emulsion side.

Advantageous surface roughening agents for use in such layers are particles of organic polymers, particularly of polymethyl methacrylate or developer-soluble polymers such as methacrylic acid-methacrylic ester copolymers, e.g. as described in U.S. Pat. No. 2,992,101. Other suitable organic polymers, when used in the particle size range, and loading needed to give the matting properties specified above, are other polyvinyl compounds or vinyl compound copolymers, e.g. as described in British Patent Specification Nos. 2 078 992 and 2 033 596 and U.S. Pat. Nos. 4,287,299 and 3,079,257. Other suitable materials include silica or composites of silica with polymer, e.g. as described in U.S. Pat. Nos. 4,235,959, 3,920,456, 3,591,379 and 3,222,037, hardened gelatin, water soluble inorganic salts, or starch, dextran and mixtures of these polymers, as described in British Patent Specification No. 2 077 935.

One type of matting agent known in the art consists of very small particles of silica, typically of diameter 0.1 micron or less. On dispersion in coating binders such as aqueous gelatine, these small particles form tightly-bound aggregates, typically of 1 micron or greater in diameter, which behave as though they were a single particle. The matting properties required for the purposes of this invention may be obtained either by the use of single particles in the required size range, or equally by use of aggregates, the overall size of which falls in the same required range.

Suitable materials of high refractive index include non-photosensitive silver halide crystals, which are readily produced in uniform sizes and removed by photographic fixers. Silver halides generally have a refractive index in the range 2.0 to 2.2. Other suitable materials of high refractive index include zinc oxide and calcium carbonate.

Gelatin is a suitable binder for all these layers and has a refractive index of about 1.5.

When small polymer or other particles, especially those of mean diameter 1 micron or below, are used to matt the surface of a layer of binder as this is coated, the height of the protrusions above the average surface level, and the number of particles protruding, is dependent not only on the weight of particles contained in the layer, but also on the coating and drying conditions used. It is important to select conditions for coating and drying which give the high degree of particle protrusion required by this invention and these parameters will be appreciated by a person skilled in the art. One technique which has proved to provide satisfactory surface roughness when used with suitable formulations is to pass the wet element immediately after coating into a chill zone at 13° C. at 30% relative humidity to cause the gel to set and thereafter to dry at 30° C., at 30% relative humidity. It was found that the thin layers were dry in 30 seconds to 1 minute.

In addition to the above matting particles introduced for the purposes of surface roughening in accordance with the invention, the photographic element can contain small quantities (less than 0.1 g/m$^2$) of larger polymer, silica or other matting agent with particles of mean diameter 5 micron and greater, to improve mechanical properties such as adhesion and abrasion resistance.

Silver halide emulsions useful in the photographic elements of this invention may comprise silver bromide, silver chloride, silver chlorobromide, silver bromoiodide or silver chlorobromoiodide, and can be prepared by any of the well known procedures, e.g. as described in Research Disclosure 17643, December 1978, par. II and III. The emulsions have a particle size of not more than 0.4 micron, generally in the range 0.05 to 0.4 micron.

The emulsions can be sensitised to near infrared using the dyes disclosed in European Patent Application Publication No. 0 088 595, or using any of the other spectral sensitising dyes known in the art to give sensitivity to radiation of wavelength 750 to 1500 nm, preferably 750 to 900 nm, e.g. as described in Mees and James, The Theory of the Photographic Process, 3rd Ed., pp. 198–199.

Silver halide emulsions present in the photographic element of this invention can be protected against the production of fog and can be stabilised against loss of sensitivity during keeping. Suitable antifoggants and stabilisers are described, for example, in Research Disclosure 17643, December 1978, par. VI.

Silver halide emulsions present in the photographic elements of this invention can employ optical brightening agents as described, for example, in Research Disclosure 17643, December 1978, par. V.

The spectrally sensitised silver halide emulsions used in the invention can contain speed increasing compounds, e.g. those described in Research Disclosure 17643, December 1978, par. XXI.

The layers of the photographic elements can contain various colloids as vehicles or binding agents, e.g. those described in Research Disclosure 17643, December 1978, par. IX. Such colloids can be hardened by various organic and inorganic hardeners, e.g. those described in Research Disclosure 17643, December 1978, par. X.

The photographic elements of the invention can contain antistatic or conducting layers, plasticisers and lubricants, surfactants, as described, for example, in Research Disclosure 17643, December 1978, par. XI, XII and XIII.

Photographic emulsions used in the invention can be coated on a wide variety of transparent supports, e.g. those described in Research Disclosure 17643, December 1978, par. XVIII.

The sensitising dyes and other emulsion addenda can be incorporated into the layers of the photographic elements by various methods known in the art, e.g. those described in Research Disclosure 17643, December 1978, par. XIV. Similarly the photographic elements can be coated on photographic supports by various procedures. Supports and coating procedures are described, for example, in Research Disclosure 17643, December 1978, par. XV and XVII.

The sensitised silver halide emulsions used in this invention can be processed after exposure to form a visible silver and/or dye image by associating the silver halide with an aqueous alkaline medium in the presence of a developing agent as described, for example, in Research Disclosure 17643, December 1978, par. XIX.

Whilst this invention is described in detail for elements containing silver halide grains below 0.4 micron in diameter, the methods for fringe suppression are equally applicable to elements containing other photosensitive silver halide crystals which may permit formation of scanner fringes due to low turbidity. In particular the invention is applicable to elements containing tabular grains of silver halide exceeding 0.4 micron in diameter, but of high aspect ratio, especially if these are present as a low overall fraction of the silver halide grains in the element, the remainder being comprised of fine grains.

The photographic elements of this invention can be useful in physical development systems, image transfer systems, dry development systems, diffusion transfer systems, printing and lithography, print-out and direct-print systems as, described, for example, in Research Disclosure 17643, December 1978, par. XXII, XXIII, XXIV, XXV, XXVI and XXVII. The invention will now be illustrated by the following Examples.

In the Examples the evaluation of the samples was conducted as follows:

EVALUATION OF SAMPLES BY NON-CONTACT LASER DIODE SCANNING, AND MEASUREMENT OF FRINGES

Samples were evaluated by uniform exposure in a scanner system in which the radiation from a Hitachi HLP 1400 laser diode emitting at 815 nm was focused to a circular spot of 50 microns diameter on the surface of the sample. The focused spot was scanned in raster pattern of of 200 lines/cm over the sample by means of an oscillating galvanometer mirror in path of the infrared beam. The intensity of the exposure was increased stepwise to produce after processing a scale from miniminum to maximum density on the sample. The samples were then developed using an automatic roller processor 3M type XP507 utilising Eastman Kodak RP X-Omat processing solutions. A visual inspection for fringe patterns was made, and these assessed using the following ranking order:

1: No fringes seen
2: Almost undetectable fringes
3: Very faint, seen only under close scrutiny
4: Diffuse patterns
5: Faint, but sharply defined fringes
6: Readily noticed fringes
7: Sharply defined fringe patterns.

The fringe patterns were quantitatively evaluated by tracing with a Joyce-Loebl MDM6 microdensitometer using a small (2.0×0.25 mm) slit aperture. The maximum transmission optical density difference (O.D.) thus measured between light and dark fringes is given in the Examples. The O.D. was measured in areas scanned to mean optical density of between 1.0 and 2.0, in which region the emulsion had contrast values of from 2.5 to 3.5.

The measurement of surface reflectivity of the samples in the Examples was conducted as follows:

MEASURE OF DIRECT (SPECULAR) SURFACE REFLECTIVITY OF MATTED BACK SURFACES

Samples were prepared prior to testing by physical removal of the photosensitive emulsion layer, and by application of a densely I.R. absorbing, non-reflective layer in its place. The untreated side of the samples was then irradiated at an angle of 10° to the normal with a collimated beam of known energy, of 5 mm diameter, from a laser diode emitting at 815 nm. A radiometric detector was used to monitor the reflected energy at a total angle of 20° to the incident beam (Optronics model 730A). This detector was sited at a distance of 30 cm from the test surface, and admitted light through a circular aperture of 1 cm diameter.

As the same detector was used to assess both incident and reflected energy, a simple calculation allowed percentage reflectivity to be ascertained. Care was taken with choice of laser diode/sample film/detector configurations to ensure that any extraneous energy was omitted from measurements.

The examination of matted surfaces of the samples in the Examples was conducted as follows:

SCANNING ELECTRON MICROSCOPE EXAMINATION OF MATTED SURFACES (S.E.M.)

A sample (approximately 1 $cm^2$) of the film was bonded to a pin stub, with the surface to be examined uppermost. A gold coating, approximately 25 nm thick, was applied, using an International Scientific Instruments Inc. (ISI) PS-2 coating unit, at 1.2 kV and 10 mA for 2 minutes. The samples were examined in an ISI Super IIIA scanning electron microscope, operating at 10 kV. The samples were angled at +20°. In each case a photograph was taken at a print magnification of 5000X, using an internal calibration marker. Particle counts were made within a grid representing an area of 10 micron ×10 micron. Particles were counted if they appeared to extend above the average surface level by at least 30% of their diameter, or 0.2 micron, whichever was smaller. In samples where only large, infrequent particles were present, photographs at 2000X or lower magnification were taken, and counts made over a more extensive area.

The results reported are an average of counts made from photographs of two different parts of each surface examined.

EXAMPLE 1

Preparation of NIR sensitive silver halide emulsions and their use in photographic elements for laser diode scanner tests.

An emulsion containing 64% silver chloride moles and 36% silver bromide moles with cubic grains having an average grain size of 0.28 micron and a narrow distribution curve was prepared by a double jet precipitation method described in Example 17B of European Patent Application Publication No. 0 088 595.

Similar emulsions having mean grain sizes of 0.23 micron, 0.20 micron, 0.16 micron and 0.13 micron were likewise prepared, using successively lower temperatures for precipitation. All these emulsions were conventionally gold and sulphur sensitised and stabilised, and NIR spectral sensitising dye, triphenylphosphine supersensitiser, wetting agents and hardener were added as described in the basic formulation in Example 18 of European Patent Application Publication No. 0 088 595. The emulsions were coated individually on transparent 0.18 mm subbed polyester base, to give 2.7 to 3.0 $g/m^2$ silver coating weight. A supercoat of 200 ml of 5% aqueous gelatin containing 100 mg Superamide L9C and 0.15 ml Teepol 610 wetting agents and 4.5 ml of 2% solution of formaldehyde hardener, but no matting agents of filter dyes, was simultaneously applied to give a top layer of 1.33 $g/m^2$ gelatin. The back surface of the film base was left uncoated. Superamide L9C is a high activity lauric acid-diethanolamine condensate commerically available from Millmaster-Onyx UK. Teepol 610 is a sodium salt of a secondary alkyl sulphate commercially available from Shell Chemicals UK Ltd.

The samples were evaluated as described above and the results shown in Table 1.

TABLE 1

| Effect of emulsion grain size on scanner fringes | | |
|---|---|---|
| Silver Halide Grain size (microns) | Visual Appearance | Fringe Optical density difference |
| 0.28 | 2 | 0.02 |
| 0.23 | 4 | 0.03 |
| 0.20 | 6 | 0.04 |
| 0.16 | 7 | 0.07 |
| 0.13 | 7 | 0.06 |

This Example demonstrates the increasing severity of scanner fringes with decreasing silver halide grain size.

EXAMPLE 2

Photographic elements according to the invention having backing layers containing PMMA particles, and resistant to scanner fringes Emulsions were prepared, NIR sensitised and coated as in Example 1, but using an 0.18 mm subbed polyester base provided with a backing layer containing 0.3 g/m$^2$ of poly(methyl methacrylate) particles of mean diameter 0.5 micron in a gelatin binder (1.3 g/m$^2$), which was coated from an aqueous solution also containing as in Example 1 Superamide L9C and Teepol 610 wetting agents, and formaldehyde hardener. Immediately after coating onto the film base, the wet backing layer was passed briefly through a chill zone, at 13° C. and 30% relative humidity, causing the gel to set, drying was then brought about at 30° C. and 30% relative humidity, and appeared to be complete within 1 minute. The samples were tested in the laser diode scanner system as described above and the results reported in Table 2.

The coatings of the same grain size emulsions in Example 1 act as control standards.

TABLE 2

| Effect of 0.5 micron PMMA particle backing | | | | |
|---|---|---|---|---|
| Silver Halide Emulsion Grain size (micron) | Backing 0.5 micron PMMA g/m$^2$ | Visual Appearance | Fringe Optical density difference | Protruding particles per (10 micron)$^2$ |
| 0.20 | 0.3 | 1 | 0.015 | 153 |
| 0.16 | 0.3 | 1 | 0.015 | 154 |
| 0.13 | 0.3 | 1 | 0.015 | 154 |

EXAMPLE 3

Photographic elements according to the invention having backing layers containing non-photosensitive silver halide grains An 0.16 micron chlorobromide emulsion was coated as in Example 1, but using a 0.18 mm polyester base provided with a backing layer containing silver halide grains, insensitive to NIR light, in a gelatin binder (1.3 g/m$^2$). The effect on scanner fringes of different sizes and loadings of backing grains is reported in Table 3.

TABLE 3

| Non-photosensitive silver halide backings | | | | |
|---|---|---|---|---|
| Particle Type | Particle Size (microns) | Coverage g/m$^2$ | Visual Appearance | Fringe O.D.D.[1] |
| None | — | — | 7 | 0.06 (control) |
| AgIBr | 0.6 | 0.4 | 2 | 0.02 |
| AgIBr | 0.6 | 0.8 | 2 | 0.02 |
| AgIBr | 1.0 | 0.5 | 2 | 0.02 |

TABLE 3-continued

| Non-photosensitive silver halide backings | | | | |
|---|---|---|---|---|
| Particle Type | Particle Size (microns) | Coverage g/m$^2$ | Visual Appearance | Fringe O.D.D.[1] |
| AgIBr | 1.0 | 1.0 | 1 | 0.015 |

[1]O.D.D. = Optical density difference

EXAMPLE 4

Photographic element having backing layer containing other surface roughening agents A 0.16 micron chlorobromide emulsion was coated as in Example 1, but on a 0.18 mm subbed polyester base having a backing containing particles (mean grain size of 0.5 to 2.0 micron) of alkali-soluble methacrylic acid-ethyl methacrylate copolymer, in a gelatin binder (1.3 g/m$^2$), which was coated from an aqueous solution containing as in example 1 Superamide L9C or Teepol 610 wetting agents, and formaldehyde hardener as in Example 1. An otherwise identical sample was prepared in which the polymer particles were replaced by a lower loading of silica particles of mean diameter 5 micron. These samples were tested in comparison with an unbacked one, and the results are reported in Table 4.

TABLE 4

| Backing Composition | Coating Weight g/m$^2$ | Visual Appearance | Fringe O.D.D.[1] | Protruding particles per (10 micron)$^2$ |
|---|---|---|---|---|
| None | — | 7 | 0.06 | — |
| Alkali soluble copolymer mean grain size of 0.5 to 2.0 microns | 0.32 | 2 | 0.02 | 46 |
| Silica 5 micron grain | 0.1 | 7 | 0.06 | 7 |

[1]O.D.D. = Optical density difference

The conventional silica matting, which falls outside the scope of the invention in particle coverage, gives no protection against fringe formation.

EXAMPLE 5

Effect of antihalation backing on scanner fringes (0.16 micron chlorobromide emulsion)

A 0.16 micron chlorobromide emulsion was coated as in Example 1, but on a 0.18 mm subbed polyester base having a backing consisting of gelatin 5 g/m$^2$, containing an antihalation dye absorbing strongly between 750 and 900 nm, (Dye 29 in European Patent Application Publication No. 0 101 646) with an optical density of 0.40 at 820 nm. This was tested in comparison with an unbacked sampled in the laser diode scanner system, and the results are reported in Table 5.

EXAMPLE 6

Use of iodobromide emulsions

A 3% iodobromide emulsion of average grain size 0.21 micron was prepared, chemically sensitised, stabilised, spectrally sensitised, and coated on transparent 0.18 mm subbed polyester base, in accordance with Example 17A of European Patent Application Publication No. 0 088 595. A topcoat of 1.3 g/m$^2$ of gelatin was simultaneously applied.

Similar coatings were made on 0.18 mm polyester based having an antihalation backing consisting of up to three consecutive layers of gelatin (5 g/m$^2$) containing a dye (Dye 29 in European Patent Application Publication No. 0 101 646), absorbing strongly between 750 and 900 nm, giving overall optical densities of 0.45, 0.8 and 1.2 at 820 nm. These coatings were tested in the laser diode scanner system, and the results reported in Table 5.

TABLE 5

| Effect of Antihalation Layers (AH) | | | | |
|---|---|---|---|---|
| Example | Emulsion | AH O.D. at 820 nm | Visual Appearance | Fringe O.D.D.[1] |
| 5 | Chlorobromide | 0 | 7 | 0.07 |
| 5 | Chlorobromide | 0.40 | 5 | 0.035 |
| 6 | Iodobromide | 0 | 7 | 0.06 |
| 6 | Iodobromide | 0.45 | 6 | 0.04 |
| 6 | Iodobromide | 0.80 | 3 | 0.025 |
| 6 | Iodobromide | 1.20 | 2 | 0.02 |

[1]O.D.D. = Optical density difference

The antihalation layers clearly aid the suppression of fringes.

EXAMPLE 7

Relation of scanner fringe formation to surface specular reflectivity and surface roughness A 0.16 micron chlorobromide emulsion was coated as in Example 1, but using 0.18 micron subbed polyester bases provided with backing layers containing a series of concentrations of PMMA particles of mean diameter 0.5 micron, coated in a gelatin binder (1.3 g/m$^2$) as in Example 2. These samples were tested in the laser diode scanner system and the effect on fringe formation is reported in Table 6.

TABLE 6

| Relation of fringe reduction to surface matting effect by 0.5 micron PMMA as measured by surface reflectivity, and physical protrusion | | | | |
|---|---|---|---|---|
| Backing g/m$^2$ 0.5 micron PMMA | Effect of Laser Scanning Visual Appearance | Effect of Laser Scanning Fringe O.D.D.[1] | Back Surface Reflectivity | Protruding Particles per (10 micron)$^2$ |
| None | 7 | 0.07 | 4.6 | 2 |
| 0.04 | 6 | 0.05 | 4.4 | 27 |
| 0.07 | 4 | 0.04 | 3.1 | 51 |
| 0.13 | 2 | 0.025 | 1.49 | 83 |
| 0.20 | 1 | 0.02 | 0.76 | 126 |
| 0.27 | 1 | 0.02 | 0.46 | 157 |

[1]O.D.D. = Optical density difference

EXAMPLE 8

Coatings with both dye antihalo and PMMA particle cover

(a) Antihalation Dye and Conventional Matting Agents only

A chlorobromide emulsion of grain size 0.26 micron was prepared and sensitised using the methods of Example 1. The emulsion was coated on a 0.18 mm polyester base, at 2.4 g/m$^2$ silver coverage, simultaneously applying a thin gelatin (1.3 g/m$^2$) topcoat containing 0.036 g/m$^2$ of PMMA particles of 2.5 micron mean diameter. The opposite side of the base was provided with a layer of gelatin (5 g/m$^2$) containing an infrared absorbing dye (Dye 17 in European Patent Application Publication No. 0 101 646) giving an infrared absorption from 750 to 900 nm, with an optical density of 0.6 at 815 nm and having a gelatin topcoat (1.3 g/m$^2$) containing 0.065 g/m$^2$ of PMMA particles of 6 microns mean diameter (backing layer). This coating was tested in a laser diode scanner and the result is reported in Table 7.

(b) Antihalation Dye and Surface Roughening Agents According to the Invention The coating in (a) was repeated, with the addition of 0.18 g/m$^2$ of 0.5 micron PMMA spheres to both the front and the back topcoat layers. The sample was tested in a laser scanner and the result reported in Table 7.

TABLE 7

| Sample | Effect of Laser Scanning Visual Appearance | Protruding Particles Per (10 Micron)$^2$ in backing layer |
|---|---|---|
| a | 5 | 2 |
| b | 1 | 35 |

Sample (a) was found to give distinctly visible, non-contact scanner fringes whereas Sample (b) did not give any non-contact scanner fringes under the most stringent conditions of laser diode scanner testing.

EXAMPLE 9

Photographic elements having outer matting layers containing particles of an alkali-soluble copolymer A 0.16 micron chlorobromide emulsion was coated as in Example 1, but on a 0.18 mm polyester base having a backing containing particles of alkali-soluble methacrylic acid-ethyl methacrylate copolymer, in a gelatin binder (1.3g/m$^2$), which was coated from an aqueous solution containing Superamide L9C and Teepol 610 wetting agents, and formaldehyde hardener as in Example 1. The copolymer particles were of mean diameter 0.75 micron but included a broad range of diameters up to 2 micron. Samples containing different densities of this matting agent were tested for fringe formation in comparison with an unbacked one, and the results are reported in Table 8.

TABLE 8

| Effect on fringe formation of matting layers of alkali-soluble copolymer applied as either backing or top coatings | | | | | |
|---|---|---|---|---|---|
| Loading of Copolymer Matting Spheres g/m$^2$ | Protruding Particles per (10 micron)$^2$ | Applied as: Outermost Backing Layer | Applied as: Emulsion Topcoat | Dye Underlayer O.D. = 0.4 at 820 mm | Visual Appearance After Scanning |
| NONE | | | | | 7 |
| 0.06 | 26 | + | | | 5 |

TABLE 8-continued

Effect on fringe formation of matting layers of alkali-soluble copolymer applied as either backing or top coatings

| Loading of Copolymer Matting Spheres g/m$^2$ | Protruding Particles per (10 micron)$^2$ | Applied as: Outermost Backing Layer | Emulsion Topcoat | Dye Underlayer O.D. = 0.4 at 820 mm | Visual Appearance After Scanning |
|---|---|---|---|---|---|
| | | + | | + | 4 |
| | | | + | | 6 |
| 0.10 | 42 | + | | | 3 |
| | | + | | + | 3 |
| | | | + | | 4 |
| 0.14 | 58 | + | | | 2–3 |
| | | + | | + | 2–3 |
| | | | + | | 3 |
| 0.20 | 70 | + | | | 1–2 |
| | | + | | + | 1–2 |
| | | | + | | 2 |

O.D. = Optical density

The degree to which fringes are suppressed is dependent on the type of construction, and on the surface density of protruding particles produced by the matting gent. Further coatings were made in a similar manner using the same 0.16 micron chlorobromide emulsion and suspensions of copolymer mating agent, but using a 0.18 mm polyester base having applied to one side an infra-red absorbing antihalation layer, as in Example 5. The matting layers were applied directly over the antihalation layer, and the photosensitive emulsion to the opposite side of the film base.

A third set of coatings has made of the same chlorobromide emulsion on an unbacked 0.18 mm polyester base, as in Example 1, except that the usual emulsion supercoat was replaced by the matting suspensions of copolymer particles as described above.

The coatings housing matting backing over an antihalation loayer and those having matting supercoats to the emulsion were also tested in the laser diode scanner, and the results represented in Table 8.

We claim:

1. A photographic element comprising a support transparent to near infrared radiation, one or more layers of a silver halide emulsion having grains of an average diameter of not more than 0.4 micron, sensitised to near infrared radiation, characterised in the element comprises one or more of:

(i) a topcoat layer which is an outermost layer on the same side of the support as the photosensitive emulsion which topcoat layer is a diffuse transmitting layer with respect to near infrared radiation, (ii) a backing layer which is an outermost layer on the side of the support remote from the photosensitive emulsion which backing layer is a diffuse reflecting layer or absorbing layer with respect to near infrared radiation, (iii) a subbing layer which is positioned between the support and the photosensitive emulsion which subbing layer is a diffuse transmitting or absorbing layer with respect to near infrared radiation, said absorbing layer having an optical density of at least 0.75 within the range of 750 to 1500 nm in the absence of a diffuse transmitting layer and an optical density of at least 0.3 within the range of 750 to 1500 nm in combination with a diffuse transmitting layer, whereby the element may be imaged by a laser scanning system emitting near infrared radiation substantially without formation of non-contact interference fringes.

2. A photographic element as claimed in claim 1, characterised in that the element comprises a backing layer, comprising a binder containing a surface roughening agent having average particle size not more than 2 micron, the backing layer having a microscopic roughness of the outer surface, such that each square millimeter of that surface contains at least 250,000 particles which protrude above the average level of that surface by at least 30% of their individual diameters, or by 0.2 micron, whichever is less.

3. A photographic element as claimed in claim 1, characterised in that the element comprises a topcoat layer, comprising a binder containing a surface roughening agent having average particle size not more than 2 micron, this topcoat layer having a microscopic roughness of the outer surface, such that each square millimeter of that surface contains at least 250,000 particles which protrude above the average level of that surface by at least 30% of their individual diameters, or by 0.2 micron, whichever is less.

4. A photographic element as claimed in claim 1, characterised in that the microscopic surface roughness is such that each square millimeter of that surface contains at least 450,000 particles which protrude above the average level of that surface by at least 30% of their individual diameters, or by 0.2 micron, whichever is less, 5. A photographic element as claimed in claim 1, characterised in that the element comprises a backing or subbing layer containing an antihalation dye absorbing light in the near infrared and having a peak transmission optical density of at least 0.75, in that range.

6. A photographic element as claimed in claim 1, characterised in that the element comprises a backing layer containing an antihalation dye giving a peak transmission optical density of at least 0.3 with respect to light in the near infrared, and containing a surface roughening agent of average particle size not more than 2 micron, this layer having a microscopic roughness of the outer surface such that each square millimeter of the outer surface contains at least 200,000 particles which protrude above the average level of that surface by at least 30% of their individual diameters, or by 0.2 micron, whichever is less.

7. A photographic element as claimed in claim 1, characterised in that the element comprises a backing layer having a peak transmission optical density of at least 0.3 with respect to light in the near infrared, and a topcoat layer containing a surface roughening agent having an average particle size not more than 2 micron, this layer having a microscopic roughness of the outer surface such that each square millimeter of that surface contains at least 200,000 particles which protrude above the average level of that surface by at least 30% of their individual diameters, or by 0.2 micron, whichever is less.

8. A photographic element as claimed in claim 1, characterised in that the element comprises an antihalation subbing layer having a peak transmission optical density of at least 0.3 with respect to light in the near infrared, and a backing layer or topcoat layer containing a surface roughening agent having an average particle size not more than 2 micron, this layer having a microscopic roughness of the outer surface such that each square millimeter of that surface contains at least 200,000 particles which protrude above the average level of that surface by at least 30% of their individual diameters, or by 0.2 micron, whichever is less.

9. A photographic element as claimed in claim 1, characterised in that the element comprises a topcoat layer containing a surface roughening agent having an average particle size not more than 2 micron, this layer having a microscopic roughness of the outer surface such that each square millimeter of that surface contains at least 200,000 particles which protrude above the average level of that surface by at least 30% of their individual diameters, or by 0.2 micron, whichever is less and a backing layer containing a surface roughening agent having an average particle size not more than 2 micron, this layer having a microscopic roughness of the outer surface such that each square millimeter of that surface contains at least 200,000 particles which protrude above the average level of that surface by at least 30% of their individual diameters, or by 0.2 micron, whichever is less, and optionally a subbing layer containing an antihalation dye providing a peak transmission optical density of at least 0.3 with respect to light in the near infrared.

10. A photographic element as claimed in claim 1, characterised in that the particles of roughening agent have an average particle size in the range 0.2 to 2 micron.

11. A photographic element as claimed in claim 1, characterised in that the roughening agent is selected from poly-methyl methacrylate and copolymers of methacrylic acid with methyl or ethyl methacrylate.

12. A method of recording an image substantially free of non-contact interference fringes which comprises exposing a photographic element as claimed in claim 1 in absence of contact with other surfaces with radiation in the near infrared from a laser diode scanning system positioned on the emulsion side of the photographic element and thereafter processing said element to develop the image.

13. A photographic element as claimed in claim 2, characterised in that the particles of roughening agent have an average particle size in the range 0.2 to 2 micron.

14. A photographic element as claimed in claim 3, characterised in that the particles of roughening agent have an average particle size in the range 0.2 to 2 micron.

15. A photographic element comprising a support transparent to near infrared radiation, one or more layers of a photosensitive silver halide emulsion having grains of an average diameter of not more than 0.4 micron, sensitized to near infrared radiation, characterized in the element comprises a backing layer which is an outermost layer on the side of the support remote from the photosensitive emulsion which backing layer is a diffuse reflecting layer with respect to near infrared radiation, whereby the element may be imaged by a laser scanning system emitting near infrared radiation substantially without formation of non-contact interference fringes.

16. A photographic element as claimed in claim 15, characterised in that the backing layer comprises a binder containing particles having a refractive index substantially larger than that of the binder having an average particle size below 5 micron, the layer(s) being removable during photographic processing.

17. A photographic element as claimed in claim 16, characterised in that the element is sensitive to radiation in the wavelength range 750 to 900 nm.

18. A photographic element as claimed in claim 16, characterised in that the material of high refractive index has an average particle size in the range 0.2 to 3 micron.

19. A photographic element as claimed in claim 18, characterised in that the material of high refractive index is selected from silver halide, zinc oxide and calcium carbonate.

20. A photographic element as claimed in claim 11, characterised in that the particles of roughening agent have an average particle size in the range 0.2 to 2 micron.

21. A photographic element comprising a support transparent to near infrared radiation, one or more layers of a silver halide emulsion having grains of an average diameter of not more than 0.4 micron, sensitised to near infrared radiation, characterised in the element has an antihalation layer on the backside of said support with an optical density of at least 0.3 in the range of 750 to 1500 nm and over said antihalation layer, a diffuse transmitting layer comprising a binder containing a surface roughening agent having an average particle size of not more than 2 microns, said diffuse transmitting layer having a microscopic roughness of the outer surface such that each square millimeter of that surface contains at least 250,000 particles which protrude above the average level of that surface by at least 30% of their individual diameters or by at least 0.2 microns, whichever is less, whereby the element may be imaged by a laser scanning system emitting near infrared radiation substantially without formation of non-contact interference or fringes.

22. The photographic element of claim 21 wherein said optical density is at least 0.75 in the range of 750 to 1500 nm.

23. The photographic element of claim 21 wherein said optical density is at least 1.2 in the range of 750 to 1500 nm.

24. A photographic element consisting essentially of a support transparent to near infrared radiation, one or more layers of a silver halide emulsion having grains of an average diameter of not more than 0.4 micron sensitized to near infrared radiation, said element being characterized by the presence of one or more of:

(i) a topcoat layer which is an outermost layer on the same side of the support as said one or more of silver halide emulsion layers, and wherein said topcoat layer is a diffuse transmitting layer with respect to near infrared radiation, (ii) a backing layer which is an outermost layer on the side of the support remote from said one or more layers of silver halide emulsion, and wherein said backing layer is a diffuse reflecting layer with respect to near infrared radiation, and (iii) a subbing layer which is positioned between the support and said one or more layers of silver halide emulsion, wherein said subbing layer is a diffuse transmitting layer, whereby the element may be imaged by a laser scanning system emitting near infrared radiation substantially without formation of non-contact interference fringes.

25. The element of claim 24 having at least one layer comprising (i) and wherein said diffuse transmitting layer comprises a binder containing a surface roughening agent having an average particle size of not more than 2 microns, said diffuse transmitting layer having a microscopic roughness of the outer surface such that each square millimeter of the surface of said diffuse transmitting layer has at least 250,000 particles which protrude above the average level of that surface by at least 30% of their individual diameters or by at least 0.2 microns, whichever is less, whereby the element by be imaged by a laser scanning system emitting near infrared radiation substantially without formation of non-contact interference fringes.

26. The photographic element of claim 15 further comprising one or more of:

(i) a topcoat layer which is an outermost layer on the same side of the support as the photosensitive emulsion which topcoat layer is a diffuse transmitting layer with respect to near infrared radiation, and (ii) a subbing layer which is positioned between the support and the photosensitive emulsion which subbing layer is a diffuse transmitting or absorbing layer with respect to near infrared radiation, said absorbing layer having an optical density of at least 0.75 within the range of 750 to 1500 nm in the absence of a diffuse transmitting layer and an optical density of at least 0.3 within the range of 750 to 1500 nm in combination with a diffuse transmitting layer.

27. The element of claim 1 wherein said backing layer is present on said element.

* * * * *